US006227279B1

(12) United States Patent
Belongia et al.

(10) Patent No.: US 6,227,279 B1
(45) Date of Patent: May 8, 2001

(54) VENETIAN TYPE BLIND HAVING SEGMENTED PIVOTING TILTING SLAT

(75) Inventors: Larry P. Belongia, Oconto; John R. Thomson, Oconto Falls, both of WI (US)

(73) Assignee: Springs Window Fashions Division, Inc., Middleton, WI (US)

( * ) Notice: Subject to any disclaimer, the term of this patent is extended or adjusted under 35 U.S.C. 154(b) by 0 days.

(21) Appl. No.: 09/495,773

(22) Filed: Feb. 1, 2000

(51) Int. Cl.[7] ..... E06B 9/303
(52) U.S. Cl. ..... 160/115; 160/176.1 R
(58) Field of Search ..... 160/115, 176.1 R, 160/116, 113, 167 R, 168.1 R, 177 R, 178.1 R, 178.3 R

(56) References Cited

U.S. PATENT DOCUMENTS

| | | | | |
|---|---|---|---|---|
| 7,408 | | 6/1850 | Bohrer . | |
| 12,695 | | 4/1855 | Rose . | |
| 2,116,356 | | 5/1938 | Laborda et al. . | |
| 2,213,021 | * | 8/1940 | Solon | 160/176.1 R |
| 2,214,539 | | 9/1940 | Reinike . | |
| 2,237,539 | * | 4/1941 | Adams et al. | 160/115 |
| 2,283,640 | | 5/1942 | Kwon . | |
| 2,427,266 | | 9/1947 | Ewing . | |
| 2,579,485 | * | 12/1951 | Ferguson et al. | 160/115 |
| 2,647,572 | * | 8/1953 | Biscoe et al. | 160/115 |
| 2,719,586 | | 10/1955 | Graham . | |
| 2,979,127 | * | 4/1961 | Brown | 160/115 |
| 5,443,108 | | 8/1995 | LeVert et al. . | |

FOREIGN PATENT DOCUMENTS

| | | | | |
|---|---|---|---|---|
| 5096 | * | 4/1888 | (GB) | 160/115 |

* cited by examiner

*Primary Examiner*—Blair M. Johnson
(74) *Attorney, Agent, or Firm*—Buchanan Ingersoll, P.C.

(57) ABSTRACT

A Venetian type blind has a bottomrail, a headrail positioned above the bottomrail, a tilting slat, and two sets of slats carried on either upper ladders or lower ladders. The tilting slat has a center segment and an end segment pivotably attached to each end of the center segment by a common axle that runs through the center segment. The first set of slats is carried on a set of upper ladders extending from the headrail to the center segment of the tilting slat. The second set of slats are carried on a set of lower ladders extending from the end segments of the tilting slat to the bottomrail. To change the lower slats to a position different from the upper slats an operator turns an end segment relative to the center segment. Since the end segments are on a common axle they will turn together. A locking tab may be provided on each end segment which will lock the end segments to the center segment. When the end segments are so locked they will turn with the center segment and all of the slats will move together.

15 Claims, 6 Drawing Sheets

VENETIAN TYPE BLIND HAVING SEGMENTED PIVOTING TILTING SLAT

FIELD OF INVENTION

This invention relates to venetian type blinds which can have slats that can be tilted from an open horizontal position to a closed tilted position.

BACKGROUND OF THE INVENTION

Venetian blinds consist of a plurality of horizontal slats. These slats rest on ladders made of cord, fabric tape, or flexible sheets of sheer material. Blinds have a headrail and bottomrail, the bottomrail being either one solid rail or two parallel rails connected by a cord. The blinds have a lift cord or cords, traditionally connected from the bottomrail through route holes in the slats, to a lift mechanism or cord lock in the headrail. In some venetian blinds the lift cords are placed proximate to the front and rear edges of the slats, and tiny notches or slots are made in the slats for the lift cords to pass through from the bottomrail into the headrail. Blinds are raised to stack slats at the top by pulling the lift cords through a cord lock, which locks into place by pulling the lift cords laterally to catch the lock and then back to set the lock. Alternately, an axle driven cord collection system may be used for one or more sets of lift cords in place of a cord lock. In this type of blind as in most venetian blinds when the blind is lowered all of the slats are in an open, horizontal position or in a closed tilted position. The blind cannot have one portion that is open and another portion which is closed unless the owner turns the slats individually. Yet, there has been a demand for blinds in which the upper half of the blind can be open while the lower half of the blind is closed or vice-versa.

One type of blind which has been offered to meet this demand is the so-called bottom-up blind. In this type of blind the slats are stacked on the bottomrail, which typically rests very near the window sill. A movingrail is placed on top of the slats and is connected to a lift cord which runs through the headrail. Pulling the lift cords raises the slats from the bottomrail. Examples of this type of blind are disclosed in U.S. Pat. No. 7408 to Bohrer, U.S. Pat. No. 12,695 to Rose, U.S. Pat. No. 2,223,640 to Kwon and U.S. Pat. No. 5,443, 108. to Levert et al. These blinds tend to be very bulky and can be awkward to operate because the movingrail is constantly changing position relative to the operator. None of these blinds allow some of the slats to be in an open horizontal position while other slats are in a closed tilted position. There is a need for a venetian blind which can do this. Ideally, this blind will also require a minimum of additional hardware. Also the blind should be able to utilize the components already commonly used such as cord ladders, fabric tape ladders, or sheer material sheet ladders. Overall, there is still a need for an easily operated, neat-looking venetian type blind with several style options wherein the upper slats can be open while the lower slats are closed or any combination thereof.

SUMMARY OF THE INVENTION

A venetian type blind that has a bottomrail, a headrail positioned above the bottomrail, a tilting segmented slat, and two sets of slats carried on either upper ladders or lower ladders. The tilting slat has a center segment and an end segment pivotably attached to each end of the center segment by a common axle that runs through the center segment. The first set of slats is carried on a set of upper ladders extending from the headrail to the center segment of the tilting slat. The second set of slats are carried on a set of lower ladders extending from the end segments of the tilting slat to the bottomrail. At least two lift cords attached to the bottomrail, run past all of the slats and through the headrail. The upper ladders are connected to a tilt mechanism within the headrail. A tilt operator such as a worm gear tilter is connected to the tilt mechanism. The tilt operator will cause the upper ladders and the center segment of the tilting slat to move. We prefer to provide a locking tab on each end segment which will lock the end segments to the center segment. When the end segments are so locked they will turn with the center segment and all of the slats will move together.

To change the lower slats to a position different from the upper slats an operator turns the end segment relative to the center segment. Since the end segments are on a common axle they will turn together. Thus, it is sufficient to turn one end segment relative to the center segment. The operator can also twist the bottomrail which is connected to the end segments via and the ladders and thus will tilt all the lower slats and the end segments. The tilting slat thereby enables the user to place the blind in any of four extreme positions when the blind is fully lowered. To simplify the description only the extreme positions of full tilt or horizontal are cited, but all the intermediary positions between the extremes are possible. All of the slats may be in a closed position; all of the slats may be in an open position; the slats on the upper ladders may be open while the slats on the lower ladders may be closed; and the slats on the upper ladders may be closed while the slats on the lower ladders may be open. The entire blind can be operated from the headrail controls when the end segments are locked to the center segment. The ladders are typically made of cord. In the preferred embodiment the lift cords run along the edges of the slats. If desired a pair of lift cords may pass through route holes in the center or on the back edges of the slats. Use of center holes for the lift cords would require modification around the axle which runs through the tilting slat. Therefore, this structure is not preferred, but it is possible.

There are several distinct advantages of this venetian type blind which set it apart from those attempted earlier. All of the components except the tilting slat are off the shelf items that are used in existing venetian blinds. One could make this blind by simply replacing one of the slats in a prior art venetian blind with the tilting slat and cutting the ladders at the location of the tilting slat to form upper ladders and lower ladders. A manufacturer will not need to produce or purchase a new and expensive hardware system or buy any new equipment to make this type of blind. The blind is installed in the same manner as existing venetian type blinds. Operation of the segmented slat is very intuitive and requires little explanation.

Other objects and advantages of this venetian type blind will become apparent from the description of certain present preferred embodiments thereof which are shown in the drawings.

DETAILED DESCRIPTION OF THE PREFERRED EMBODIMENTS

Figure 1:
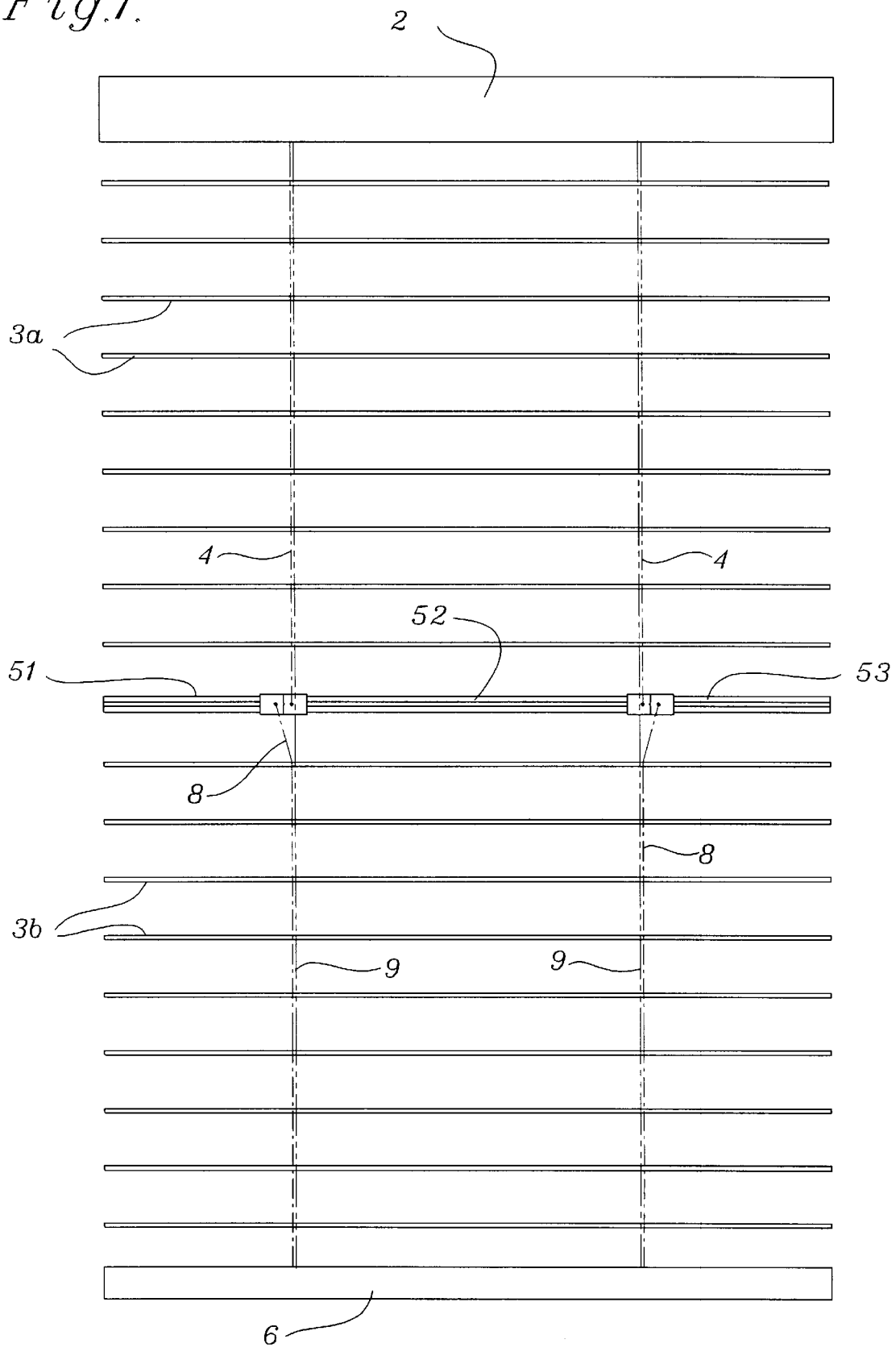
FIG. 1 is a front view of the present preferred embodiment of the venetian type blind shown in a fully lowered, fully open position.

Referring to FIGS. 1–5 a present preferred embodiment of the venetian blind 1 has a conventional headrail 2 which contains a tilt mechanism (not shown) and a conventional bottomrail 6 with slats positioned between the headrail and the bottomrail. There is an upper set of slats 3*a* which are hung on a set of upper ladders 4 which extend from the tilt mechanism in the headrail 2. The lower end on the upper ladders is attached to the center segment 52 of tilting slat 5. A set of lower slats 3*b* is carried on lower ladders 8. The lower ladders extend from one of the end segments 51 or 53 of the tilting slat 5 to the bottomrail. Lift cords 9 extend from the bottomrail 6 along the edges of the slats and into the headrail 2. The lift cords may be collected on an axle within the headrail or pass out of the headrail through a cord lock (not shown). Hence, the lift cords are operated in the conventional manner. These lift cords could be routed through holes located near the edges of the slats. It is also possible to route the lift cords through center holes in the slats but this option is not preferred. It would be necessary to modify the area around the axle which passes through the tilting slat to accommodate center holes through the tilting slat. The ladders 4 and 8 preferably are cord ladders. If desired, cord ladders could be replaced with fabric tape ladders or sheets of flexible material.

The number of ladders and lift cords may vary according to the width of the blind. For illustration purposes the blind is shown with nine upper slat and nine lower slats. However, there does not need to be an equal number of upper slats and lower slats. The total number of slats will, of course, be dependent upon the length of the blind. Any number of slats, most likely more than are shown, will be used. The slats shown are symmetric to a horizontal plane passing through the front and back edges of the slat. Other types of slats, such as crowned, s-shaped, or asymmetrical slats, may be used instead of the flat slats.

Figure 2:
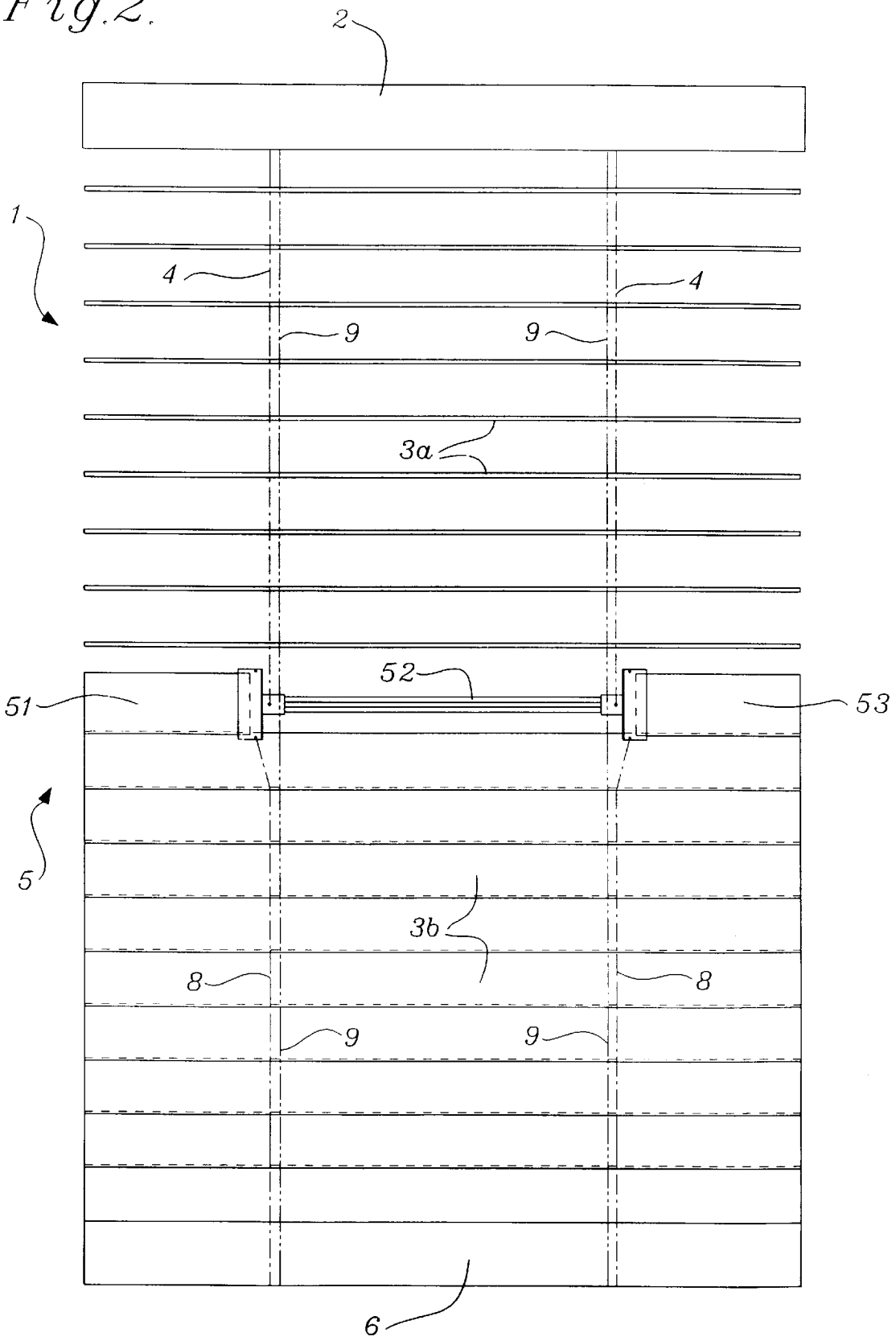
FIG. 2 is a front view similar to FIG. 1 showing the blind when it is in a fully lowered position with the upper slats open and the lower slats in a closed position.
Figure 3:
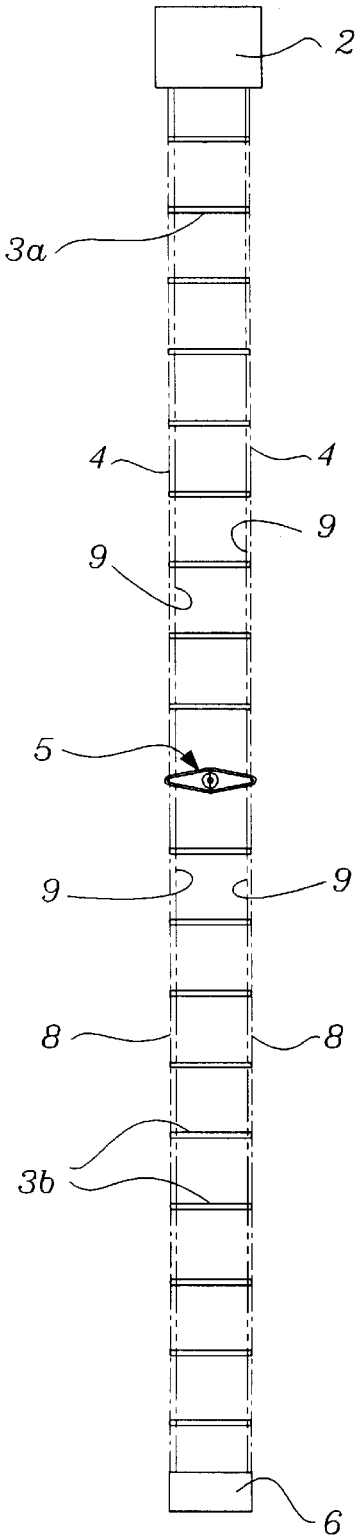
FIG. 3 is an end view of the blind in the fully lowered, fully open position shown in FIG. 1.
Figure 4:
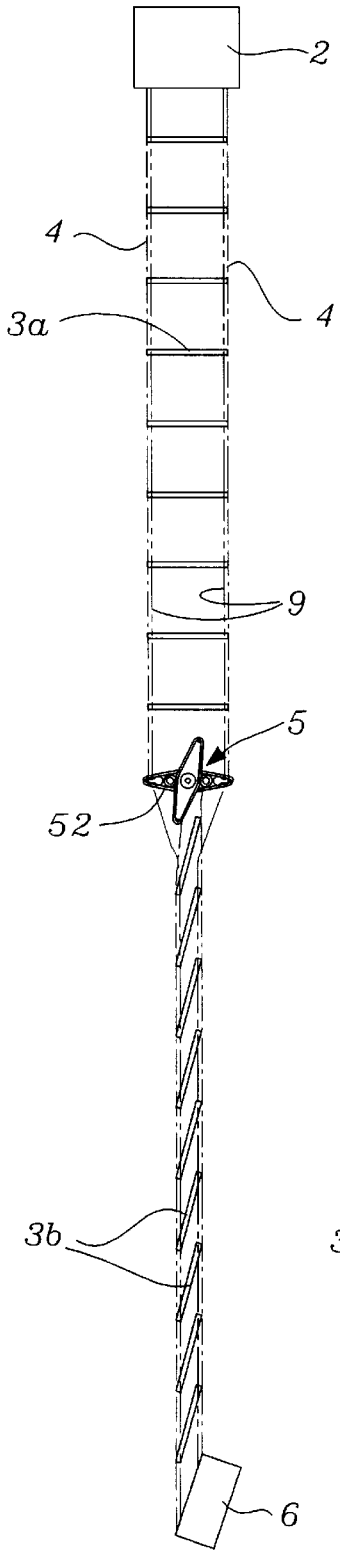
FIG. 4 is an end view showing the blind when it is in a fully lowered position with the upper slats open and the lower slats in a closed position as shown in FIG. 2.
Figure 5:
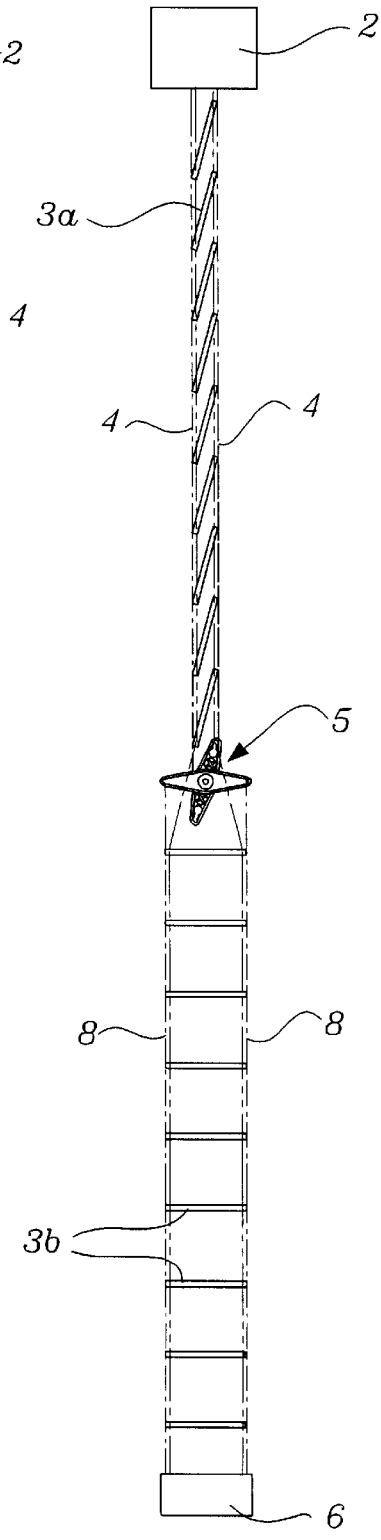
FIG. 5 is an end view similar to FIGS. 3 and 4 showing the blind when it is in a fully lowered position with the upper slats in a closed position and the lower slats in an open position.
Figure 6:
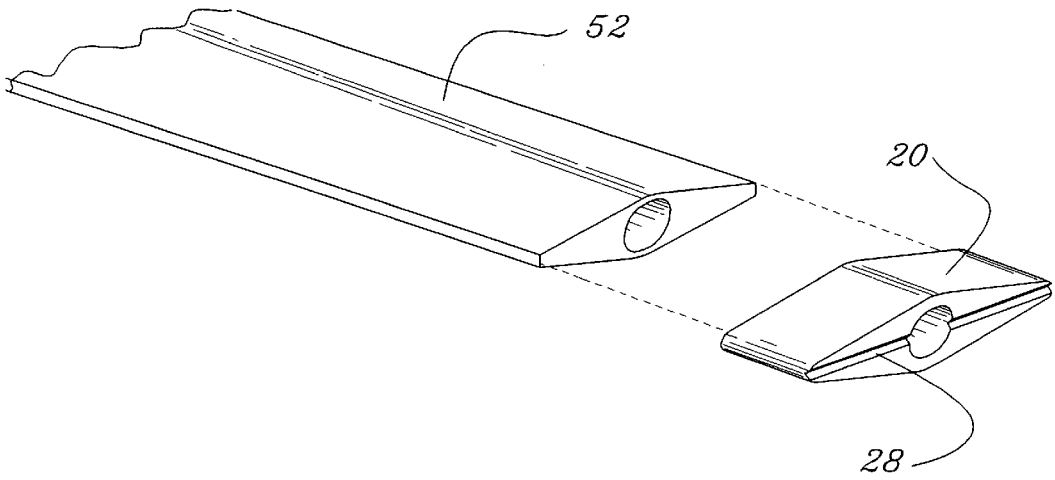
FIG. 6 is a perspective view showing how a locking cap fits over the ends of the center segment of the tilting slat.
Figure 7:
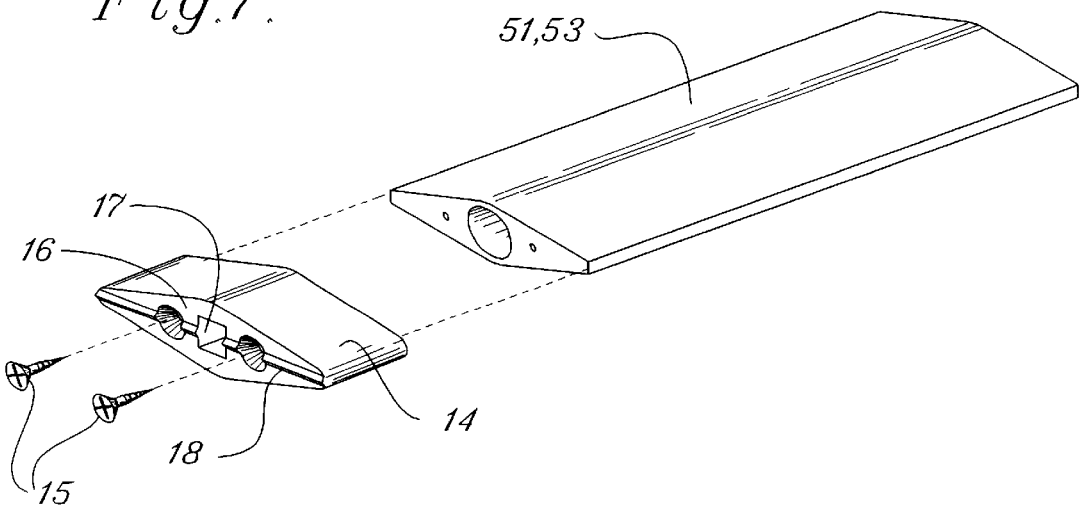
FIG. 7 is a perspective view similar to FIG. 6 showing how the locking cap which mates with the locking cap shown in FIG. 6 fits over the mating end of the end segments.
Figure 8:
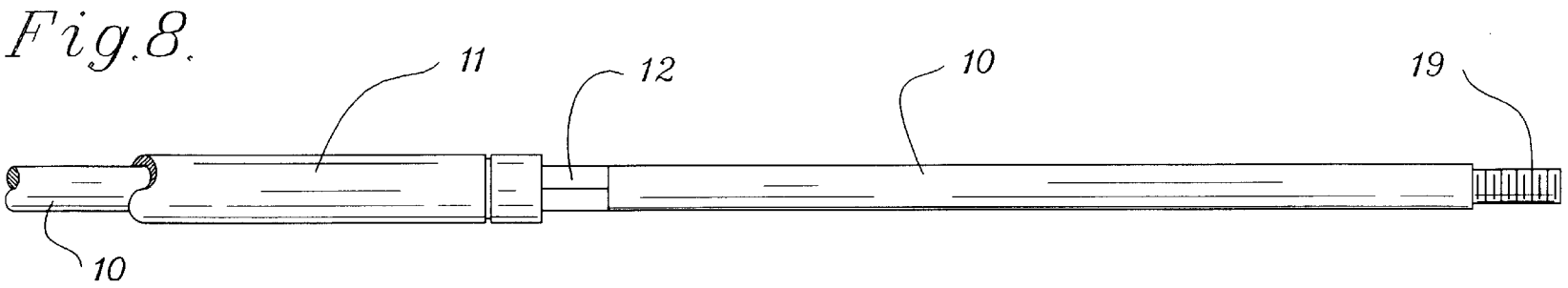
FIG. 8 is a plan view showing a portion of the axle which runs through the tilting slat.
Figure 9:
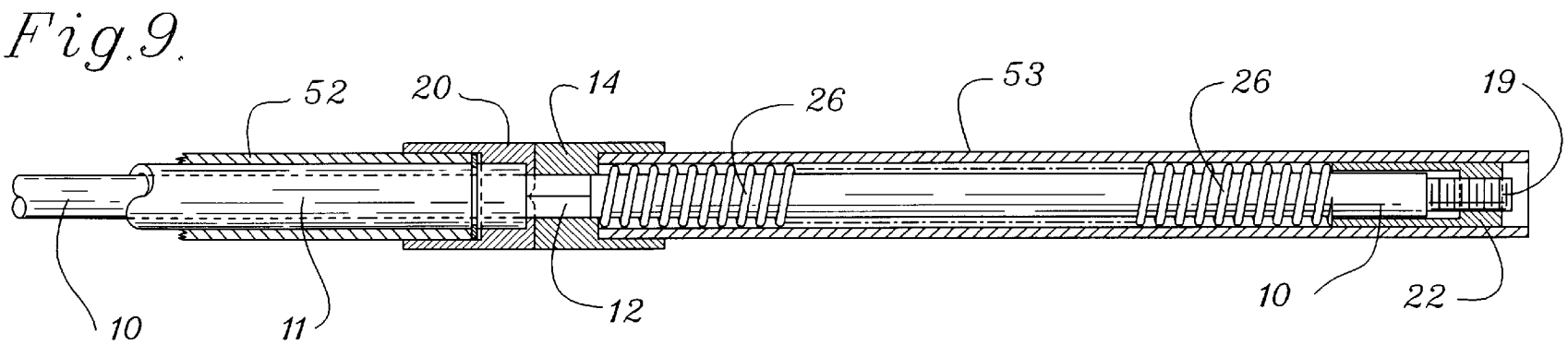
FIG. 9 is a sectional view of the axle portion shown in FIG. 8 within the tilting slat.

To change the blind from the fully open position shown in FIGS. 1 and 3 to the upper slats open, lower slats closed position shown in FIGS. 2 and 4, the operator holds the center segment 52 in the horizontal position while turning on of the end segments 51 or 53 to a vertical position. The end segments are attached to either end of an axle 10 which runs through the center segment 51. As can be seen most clearly in FIGS. 8 and 9 a sleeve 11 surrounds the center portion of the axle 10 and is attached to the center segment 51. This allows the axle 10 to turn freely within the center segment. A segment 12 of the axle adjacent either end of the sleeve has a square cross section. A locking cap 14 is attached to the end of each end segment 51, 53 which is adjacent the center segment 52. These caps 14 are held in place on the end segments by screws 15. The face 16 of the locking cap 14 has a square hole 17 which mates with the square segment 12 of the axle 10. Consequently, when an operator turns an end segment 51 or 53 either directly by hand or via the bottomrail the axle 10 will turn and both end segments will move together. Since the lower ladders are attached to the end segments 51 and 53 turning the end segments will cause the rails of the lower ladders to move relative to one another thereby moving the slats to a closed position shown in FIGS. 2 and 4. To return the slats to the open position the end segments are returned to the starting position.

To achieve a blind with the upper slats closed and the lower slats open begin with all of the slats in a fully closed position. Then the operator turns one of the end segments 51 or 53 to a horizontal position while retaining the center segment 52 in the closed position. Usually the inertia of the upper slats and ladders will maintain their position without being held by the operator, so that the blind can be tilted to any position by using the headrail controls and the end segments or bottomrail.

Figure 10:
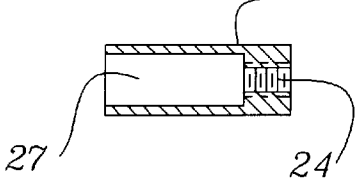
FIG. 10 is a sectional view of the retainer which fits on the end of the axle.
Figure 11:
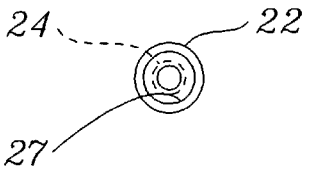
FIG. 11 is an end view of the axle without the retainer.
Figure 12:
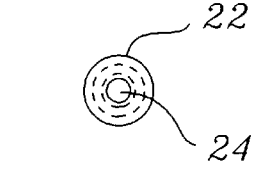
FIG. 12 is an end view similar to FIG. 11 showing the axle with the retainer.
Figure 13:
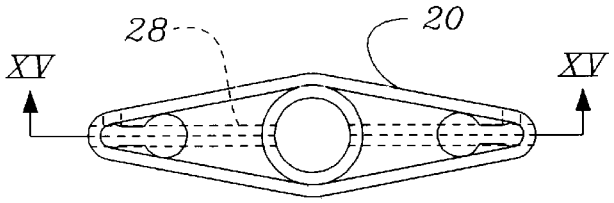
FIG. 13 is an end view showing one end of a present preferred female locking cap which is used in the tilting rod.
Figure 14:
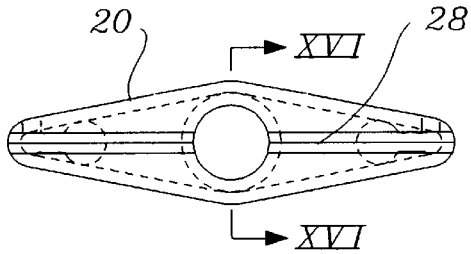
FIG. 14 is an end view showing the opposite end of the locking cap illustrated in FIG. 3.
Figure 15:
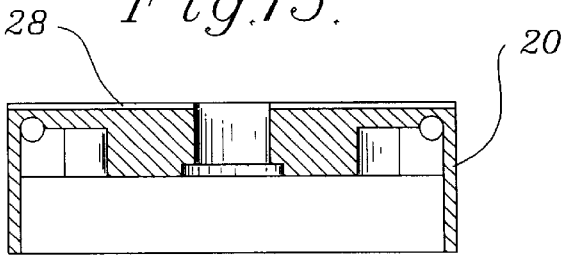
FIG. 15 is a sectional view taken along the line XV—XV in FIG. 13.
Figure 16:
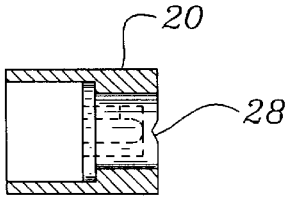
FIG. 16 is a sectional taken along the line XVI—XVI in FIG. 14.
Figure 17:
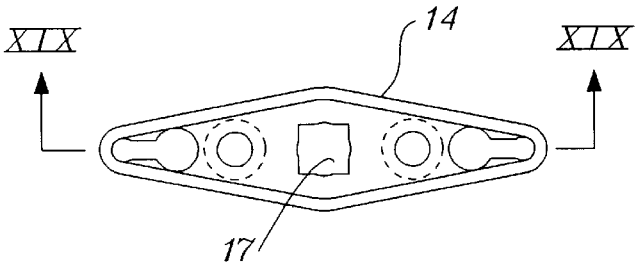
FIG. 17 is an end view showing one end of the present preferred male locking cap which is used in the tilting rod.
Figure 18:
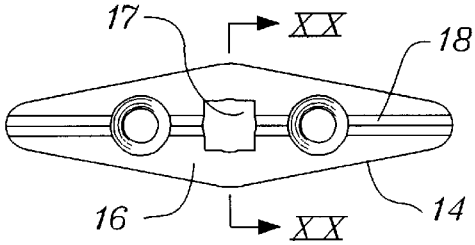
FIG. 18 is an end view showing the opposite end of the locking cap illustrated in FIG. 17.
Figure 19:
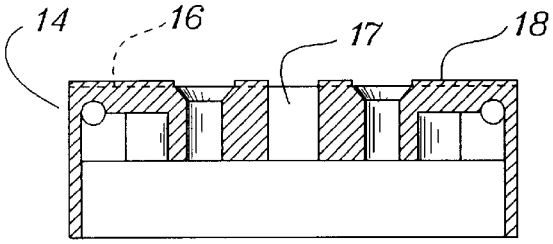
FIG. 19 is a sectional view taken along the line XIX—XIX in FIG. 17.
Figure 20:
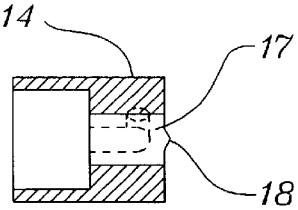
FIG. 20 is a sectional taken along the line XX—XX in FIG. 18.

A locking cap 20 shown in FIGS. 6 and 13 through 16 is attached to the ends of the center segment 52. These caps 20 have a slot 28 which receives a tab or detents 18 on the face 16 of locking cap 14 which is on the end segments 51 or 53. Each end of the axle 10 has a threaded portion 19. A connector 22 shown in FIGS. 9 and 10 has a cavity 27 at one end which receives the axle 10. The opposite end of the connector 22 has a threaded bore 24 which enables the connector to be screwed onto the end 19 of the axle 10. The connector 22 fits within a central bore passing through the end segment and is attached to the end segment A spring 26 surrounds the portion of the axle 10 between the connector 22 and the locking cap 14. The spring permits adjustment of the tension between the locking caps 14 and 20.

No specialized hardware is needed, because the lifting and tilting mechanisms consist of hardware common to venetian type blinds. Indeed, existing venetian blind can be easily modified to create the present blind by simply adding the tilting slat. The manufacturer can use preexisting pieces of hardware to create a headrail which can then be used for any type of blind: traditional top stacking, centerline lifting, or edge lift (no-holes) lifting, or blinds that have two tiers of slats that can tilt independently.

In the preferred embodiment, the upper ladders are connected to the center segment of the tilting slat and the lower ladders are connected to the end segments. This could be reversed. The upper ladders could be attached to the end segments with the lower ladders being attached to the end segments with the lower ladders being attached to the center segment.

Although we have shown and described certain present preferred embodiments of my venetian blind it should be distinctly understood that the invention is not limited thereto but may be variously embodied within the scope of the following claims.

We claim:

1. A venetian type blind comprising:

a bottomrail;

a headrail positioned above the bottomrail;

a plurality of upper ladders extending from the headrail toward the bottomrail each upper ladder having a front rail and a rear rail;

a plurality of lower ladders extending from the bottomrail toward the headrail each lower ladder having a front rail and a rear rail;

a tilting slat having a center segment and opposite end segments pivotably connected to the center segment such that the upper ladders are connected to one of the center segment and the end segments and the lower ladders are connected to the other of the center segment and the end segments;

a plurality of upper slats carried on the upper ladders;

a plurality of lower slats carried on the lower ladders;

at least two lift cords attached to the bottomrail, running past the lower slats and the upper slats and passing into the headrail; and a locking device connected between the center segment and an end segment, wherein the locking device is at least one detent in one of the center segment and the end segment and a mating slot in the other of the center segment and the end segment.

2. The venetian blind of claim 1 also comprising an axle which passes through the center segment and to which the end segments are attached to pivotably connect the end segments to the center segment.

3. The venetian blind of claim 2 also comprising a spring surrounding the axle and within an end segment and a connector attached to the spring and the axle.

4. The Venetian type blind of claim 1 wherein the slats are symmetrical to a plane passing from the front edge to the back edge of the slats.

5. The venetian type blind of claim 1 wherein the slats are one of wood, aluminum and plastic.

6. The venetian type blind of claim 1 also comprising a tilt mechanism attached to the headrail and the upper ladders.

7. A venetian type blind comprising:

a bottomrail;

a headrail positioned above the bottomrail;

a plurality of upper ladders extending from the headrail toward the bottomrail each upper ladder having a front rail and a rear rail;

a plurality of lower ladders extending from the bottomrail toward the headrail each lower ladder having a front rail and a rear rail;

tilting slat having a center segment and opposite end segments pivotably connected to the center segment such that the upper ladders are connected to one of the center segment and the end segments and the lower ladders are connected to the other of the center segment and the end segments;

a plurality of upper slats carried on the upper ladders;

a plurality of lower slats carried on the lower ladders;

at least two lift cords attached to the bottomrail, running past the lower slats and the upper slats and passing into the headrail;

an axle which passes through the center segment and to which the end segments are attached to pivotably connect the end segments to the center segment; and a spring surrounding the axle and within an end segment and a connector attached to the spring and the axle.

8. A Venetian type blind comprising:

a bottomrail;

a headrail positioned above the bottomrail;

a plurality of upper ladders extending from the headrail toward the bottomrail each upper ladder having a front rail and a rear rail;

a plurality of upper slats carried on the upper ladders;

a plurality of lower ladders extending from the bottomrail toward the headrail each lower ladder having a front rail and a rear rail;

a plurality of lower slats carried on the lower ladders;

a tilting slat located between the plurality of upper slats and the plurality of lower slats, the tilting slat having a center segment and opposite end segments pivotally connected to the center segment such that the upper ladders are connected to one of the center segment and the end segments and the lower ladders are connected to the other of the center segment and the end segments; and at least two lift cords attached to the bottomrail, running past the lower slats and the upper slats and passing into the headrail.

9. The venetian type blind of claim 8 also comprising a locking device connected between the center segment and an end segment.

10. The venetian type blind of claim 8 wherein the locking device is at least one detent in one of the center segment and the end segment and a mating slot in the other of the center segment and the end segment.

11. The venetian blind of claim 8 also comprising an axle which passes through the center segment and to which the end segments are attached to pivotably connect the end segments to the center segment.

12. The venetian blind of claim 11 also comprising a spring surrounding the axle and within an end segment and a connector attached to the spring and the axle.

13. The venetian type blind of claim 8 wherein the slats are symmetrical to a plane passing from the front edge to the back edge of the slats.

14. The venetian type blind of claim 8 wherein the slats are one of wood, aluminum and plastic.

15. The venetian type blind of claim 8 also comprising a tilt mechanism attached to the headrail and the upper ladders.

* * * * *

UNITED STATES PATENT AND TRADEMARK OFFICE

CERTIFICATE OF CORRECTION

PATENT NO. : 6,227,279 B1 
DATED : May 8, 2001
INVENTOR(S) : Larry P. Belongia, John R. Thomson It is certified that error appears in the above-identified patent and that said Letters Patent is hereby corrected as shown below:

Column 6, claim 7,
Line 1, before "tilting" insert -- a --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*